US009617874B2

(12) United States Patent
Hellweg et al.

(10) Patent No.: US 9,617,874 B2
(45) Date of Patent: Apr. 11, 2017

(54) STEAM POWER PLANT TURBINE AND CONTROL METHOD FOR OPERATING AT LOW LOAD

(71) Applicant: ALSTOM Technology Ltd, Baden (CH)

(72) Inventors: Stephan Hellweg, Oetigheim (DE); Volker Schüle, Leimen (DE); Manfred Bauer, Büdingen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 152 days.

(21) Appl. No.: 13/919,259

(22) Filed: Jun. 17, 2013

(65) Prior Publication Data

US 2014/0366537 A1 Dec. 18, 2014

(51) Int. Cl.
*F01K 11/02* (2006.01)
*F01K 7/24* (2006.01)
(Continued)

(52) U.S. Cl.
CPC ..... *F01K 7/24* (2013.01); *F01K 7/345* (2013.01); *F01K 7/40* (2013.01); *F01K 13/02* (2013.01)

(58) Field of Classification Search
CPC ... F01K 11/02; F01K 7/38; F01K 7/34; F01K 21/00; F01K 13/00; F01K 23/16
See application file for complete search history.

(56) References Cited

U.S. PATENT DOCUMENTS 3,016,712 A * 1/1962 Taylor ..... 60/676
3,973,402 A * 8/1976 Silvestri, Jr. ..... F01K 7/38 376/407

(Continued)

FOREIGN PATENT DOCUMENTS

DE 102011100517 A1 11/2012
EP 1428987 A1 6/2004

(Continued)

OTHER PUBLICATIONS

Performance Increase Through World Class Technology and Implementation by Andreas Schaarschmidt (2005).*

(Continued)

*Primary Examiner* — Audrey K Bradley
*Assistant Examiner* — Shafiq Mian
(74) *Attorney, Agent, or Firm* — GE Global Patent Operations; Marc A. Vivenzio

(57) ABSTRACT

In a system for effecting pressure control in a thermal power plant operated at low load connected fluidly in series, a relief conduit is disclosed herein. The relief conduit selectively transfers steam from a cold reheat conduit to the second extraction conduit. The plant further includes a boiler, a high-pressure turbine, an intermediate pressure turbine, a low pressure turbine, a main steam conduit for feeding steam from the boiler to an inlet of the high pressure turbine, a cold reheat conduit for feeding steam from an outlet of the high-pressure turbine through a reheat flow path in the boiler, and a first and second high pressure heaters. A first extraction conduit connects the cold reheat conduit to a first high pressure heater to transfer heat, and a second extraction conduit connects the intermediate pressure turbine to the second high pressure heater, to transfer heat.

9 Claims, 2 Drawing Sheets

(51) Int. Cl.

| | |
|---|---|
| ***F01K 7/34*** | (2006.01) |
| ***F01K 7/40*** | (2006.01) |
| ***F01K 13/02*** | (2006.01) |

(56) References Cited

U.S. PATENT DOCUMENTS

| | | | | |
|---|---|---|---|---|
| 4,003,786 | A * | 1/1977 | Cahn | F01K 7/345 376/322 |
| 4,651,533 | A | 3/1987 | Ura et al. | |
| 4,870,823 | A | 10/1989 | Silvestri, Jr. | |
| 5,545,384 | A * | 8/1996 | Harato | C01F 7/47 423/121 |
| 6,038,851 | A * | 3/2000 | Shiba | F01K 23/10 60/39.182 |
| 6,216,443 | B1 * | 4/2001 | Utamura | F01K 21/047 181/214 |
| 7,040,095 | B1 * | 5/2006 | Lang | F01K 7/42 60/653 |
| 7,325,400 | B2 * | 2/2008 | Cunningham | F01K 7/40 60/645 |
| 7,861,527 | B2 | 1/2011 | Xu | |
| 2004/0013511 | A1 * | 1/2004 | Brackenhammer | F01K 7/22 415/1 |
| 2004/0105518 | A1 * | 6/2004 | Abel et al. | 376/210 |
| 2004/0261417 | A1 | 12/2004 | Yamashita et al. | |
| 2006/0266039 | A1 | 11/2006 | Skowronski et al. | |
| 2008/0302107 | A1 * | 12/2008 | Fan | B01D 53/002 60/783 |
| 2010/0326074 | A1 * | 12/2010 | Okita | B01D 53/1425 60/648 |
| 2011/0000213 | A1 * | 1/2011 | Skowronski | F01K 3/18 60/650 |
| 2011/0100008 | A1 * | 5/2011 | Beul | F01K 7/025 60/645 |
| 2011/0110759 | A1 * | 5/2011 | Sanchez | F02C 6/04 415/1 |
| 2012/0111007 | A1 * | 5/2012 | Fruh | F01K 17/02 60/648 |
| 2012/0227406 | A1 * | 9/2012 | Kosaka et al. | 60/667 |
| 2012/0255309 | A1 * | 10/2012 | Venetos et al. | 60/772 |
| 2012/0272649 | A1 * | 11/2012 | Berndt | F01K 7/22 60/645 |
| 2012/0297771 | A1 * | 11/2012 | Sanchez | F01K 7/40 60/645 |
| 2013/0186101 | A1 * | 7/2013 | Mundra | F02C 7/18 60/785 |
| 2013/0205781 | A1 * | 8/2013 | Majumdar | F01K 17/02 60/648 |
| 2014/0033716 | A1 * | 2/2014 | Itou | F01K 13/02 60/707 |
| 2014/0090378 | A1 | 4/2014 | Dengel | |

FOREIGN PATENT DOCUMENTS

| | | | |
|---|---|---|---|
| EP | 2474709 | A1 | 7/2012 |
| EP | 2481885 | A1 | 8/2012 |
| GB | 1524236 | A | 9/1978 |
| WO | WO 2011042739 | A2 * | 4/2011 |

OTHER PUBLICATIONS

PCT Search Report and Written Opinion issued in connection with corresponding PCT Application No. PCT/IB2014/001080 on Mar. 23, 2015.

* cited by examiner

STEAM POWER PLANT TURBINE AND CONTROL METHOD FOR OPERATING AT LOW LOAD

FIELD OF THE INVENTION

The present disclosure relates, in general, to a thermal power plant and more particularly to a fossil fuel combustion thermal power plant including a steam turbine and a control method for a thermal power plant frequently operated at low load.

BACKGROUND OF THE INVENTION

During the operation of steam turbines in a boiler fired power, often there is a need to run turbines at low load levels for extended periods of times. Conventional steam power plants are designed to operate at rated load, and thus operation at low load level results in a decrease in energy utilization and efficiency.

When the load of a steam turbine is reduced, pressure in the reheat system drops in direct proportion to the steam flow. Reheat pressure is a sensitive parameter in a power plant. This is because in most steam power plants the highest feedwater heater is connected to the cold reheat system. The cold reheat pressure is directly related to the feedwater temperature at the boiler inlet. Thus, when the cold reheat pressure is reduced, the feedwater temperature at the boiler inlet is also reduced. Further, with a reduced reheat pressure, the temperature at the outlet of the hot reheat system will drop, resulting into reduced cycle efficiency.

At low loads, it is therefore advantageous to maintain the reheat pressure at high levels in order to avoid imposing temperature related stresses on boiler and turbine parts. Further, it is very advantageous to maintain the reheat pressure at high levels because with elevated back pressure, the duty of the reheat system is reduced while maintaining a generally constant steam flow rate. As a result, the temperature levels at steam turbine exhaust rises and also the outlet of the hot reheat system will rise correspondingly.

One system for maintaining temperatures at low load, includes extracting steam from a steam generator into a heat reservoir, for use in other systems or process, in order to reduce the mass flow of steam through the superheater system, so that the live steam temperature is increased. This solution, however, requires a conduit connection point on the steam generator to accommodate the extracted steam, and further does not provide an increase in pressure of the reheat system.

Other systems increase pressure at the inlet of the highest top heater of the water steam cycle by shifting the extraction point to a higher pressure level, which will only be possible when this high pressure extraction is available. However, retrofitting a power plant to this solution requires an additional extraction point in the system, which is an expensive solution.

None of the existing solutions provide an increase in extraction pressure at the highest top heater, while maintaining the same number of high pressure extraction points on the water-steam cycle.

Therefore, an object of the present disclosure is to provide a thermal power plant, steam turbine, and a control method for a partial load operation that maintains or increase back pressure at low load, minimizes temperature variation, without requiring additional high pressure extraction points.

SUMMARY OF THE INVENTION

According to aspects illustrated herein, there is provided, a system for effecting pressure control in a thermal power plant operated at low load connected fluidly in series. The plant comprises a boiler for burning fossil fuel to generate steam; a steam turbine including a high-pressure turbine, an intermediate pressure turbine, and a low pressure turbine which are driven by steam generated in the boiler; a main steam conduit for feeding steam from the boiler to an inlet of the high pressure turbine; and a cold reheat conduit for feeding steam from an outlet of the high-pressure turbine through a reheat flow path in the boiler. The cold reheat conduit operatively connected to a hot reheat conduit for feeding reheat steam to an inlet of intermediate pressure turbine. The further includes a crossover conduit for feeding steam from an outlet of the intermediate turbine to a low pressure turbine; and a low pressure exhaust conduit operatively connected to a feedwater conduit. The feedwater conduit provides feedwater in series though a first and second high pressure heaters prior to sending feedwater through the boiler to produce steam into the main steam conduit. The plant further includes a first extraction conduit operatively connecting the cold reheat conduit to the first high pressure heater, in which the first high pressure heater is operatively associated with the feedwater conduit to transfer heat. The plant further includes a second extraction conduit operatively connecting the intermediate pressure turbine to the second high pressure heater, in which the second high pressure heater is operatively associated with the feedwater conduit to transfer heat, and the second high pressure heater positioned upstream of the first high pressure heater. The plant further includes a relief conduit selectively transferring steam from the cold reheat conduit to the second extraction conduit.

In yet another aspect, the intermediate pressure turbine is a partial intermediate pressure turbine. In still another aspect, the partial intermediate pressure turbine includes a front stage section with a reduced swallowing capacity.

In yet another aspect, the relief conduit includes a relief valve.

In yet another aspect the plant further includes a bypass conduit. The bypass conduit is operatively connected to the feedwater conduit so as to selectively allow feedwater to bypass the second high pressure heater and load the first high pressure heater.

In yet another aspect the plant further a bypass conduit, in which the bypass conduit is operatively connected to the feedwater conduit so as to selectively allow feedwater to bypass the second high pressure heater and load the first high pressure heater, and the intermediate pressure turbine is a partial intermediate pressure turbine.

The various novel features that characterize the subject systems and methods, and advantages related thereto are specified in the accompanying drawings and detailed description provided below.

Figure 1:
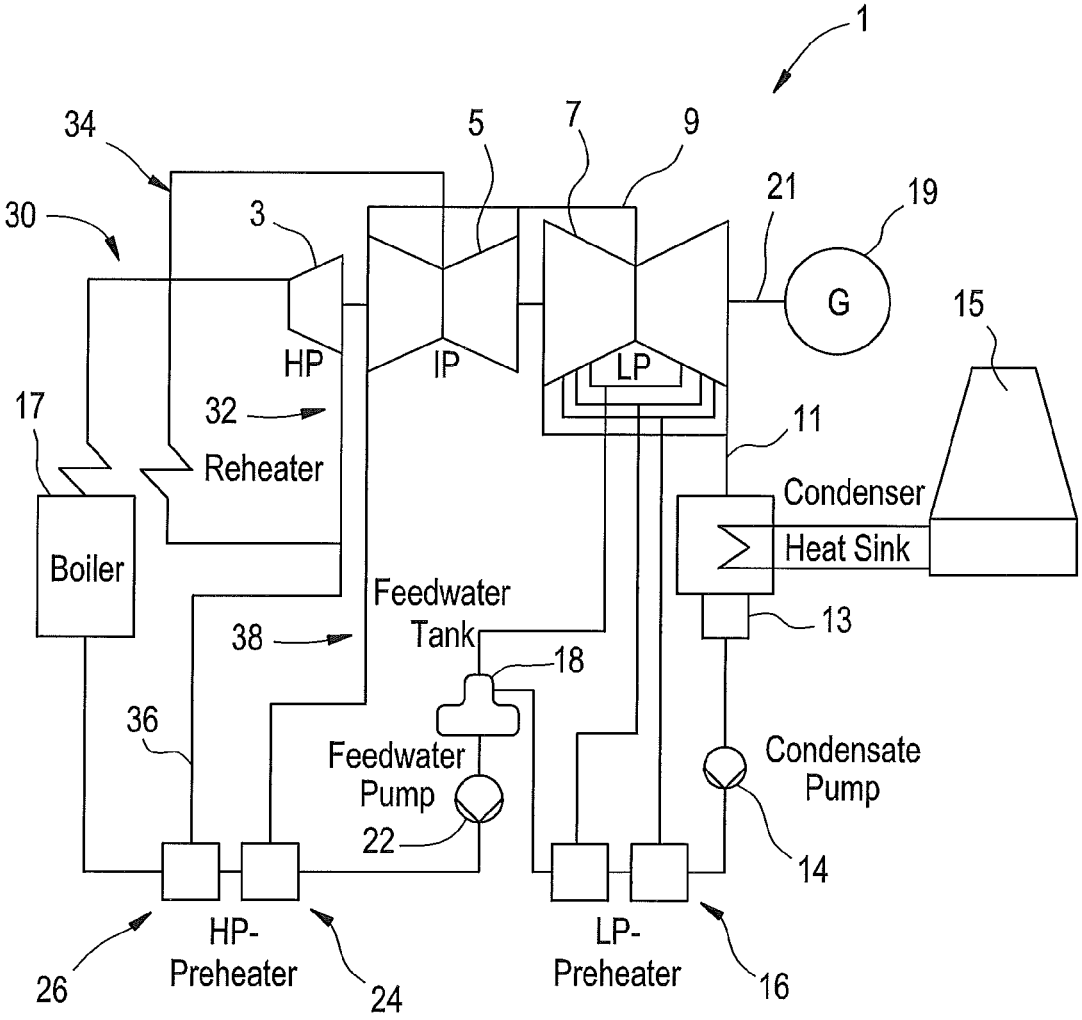
FIG. 1 PRIOR ART
FIG. 1 is a schematic view illustrating a conventional power plant with three or more partial steam turbines.

The advantages and features of the present disclosure will be better understood with reference to the following detailed description and claims taken in conjunction with the accompanying drawings, wherein like elements are identified with like symbols. Like reference numerals refer to like parts throughout the description.

DETAILED DESCRIPTION OF THE INVENTION

FIG. 1 shows a schematic view illustrating a prior art conventional power plant with three or more steam turbines. In this exemplary embodiment, the steam turbine 1 is of the multi-pressure single shaft type and comprises a high-pressure turbine 3, an intermediate pressure turbine 5, and a low pressure turbine 7 (also abbreviated herein as HP, IP, and LP), which are driven to rotate by the steam generated by a boiler 17, a generator 19 for converting the turning force of the steam turbine to electric power, a condenser 13, for condensing the steam to water, and a water feed system for feeding the feedwater condensed to the water by the condenser 13 to the boiler 17.

The high-pressure turbine 3, the intermediate-pressure turbine 5, the low-pressure turbine 7, and the generator 19 are connected to each other via a turbine rotor 21 and the electric power of each turbine is transferred to the generator 19 via the turbine rotor 21 and is taken out as electric power.

The boiler 17 heats feedwater fed from the condenser 13 by heat obtained by burning fossil fuel and generates high-temperature and high-pressure steam. The steam generated by the boiler 17 flows through a main steam conduit 30, is fed to the high-pressure turbine 3, and is reduced in pressure due to power generated in the high-pressure turbine. The steam driving the high-pressure turbine 3 flows down through a cold reheat conduit 32 and is returned again to the boiler to be reheated to hot reheat steam.

The reheat steam reheated by the boiler 17 flows through a hot reheat conduit 34, is fed to the intermediate-pressure turbine 5, and is reduced in pressure due to power generated in the intermediate-pressure turbine 5. The steam driving the intermediate-pressure turbine 5 flows through a crossover conduit 9 which is a connection conduit for connecting the intermediate-pressure turbine 5 and the low-pressure turbine 7. The steam is fed to the low-pressure turbine 7, and is further reduced in pressure due to power generated in the low-pressure turbine 7. The steam driving the low-pressure turbine 7 is fed to the condenser 13 via a low pressure exhaust channel 11 and is cooled and condensed to feedwater by the condenser 13. The condenser can be of a surface condenser type that is connected to a wet cooling system, for example a natural or mechanical draught cooling tower.

The steam flows through a condensate pump 14 to form a condensate and then through one or more low pressure feedwater preheaters 16 to a feedwater tank 18. The feedwater tank provides storage capacity and deaerates the condensate.

Downstream of the feedwater tank 18 a further feedwater pump 22 increases the pressure of the condensate (from here on called feedwater) to the required level and pumps the feedwater through high pressure heaters 24 and 26 (also known as HP heaters) into the boiler 17.

FIG. 1 further shows two high pressure ("HP") extraction conduits, 36 and 38. Extraction conduit 36 is fed by the cold reheat system 32. Extraction conduit 38 is fed by steam extracted from IP turbine 5. HP heater 26, also referred to as the highest HP heater, or the first HP heater, is in fluid communication with the cold reheat conduit 32, and allows heat to be transferred to the feedwater. HP heater 24, also known as the second highest HP-heater, or second HP heater, is in fluid communication with the IP turbine 5 and allows the steam to transfer heat to feedwater.

Figure 2:
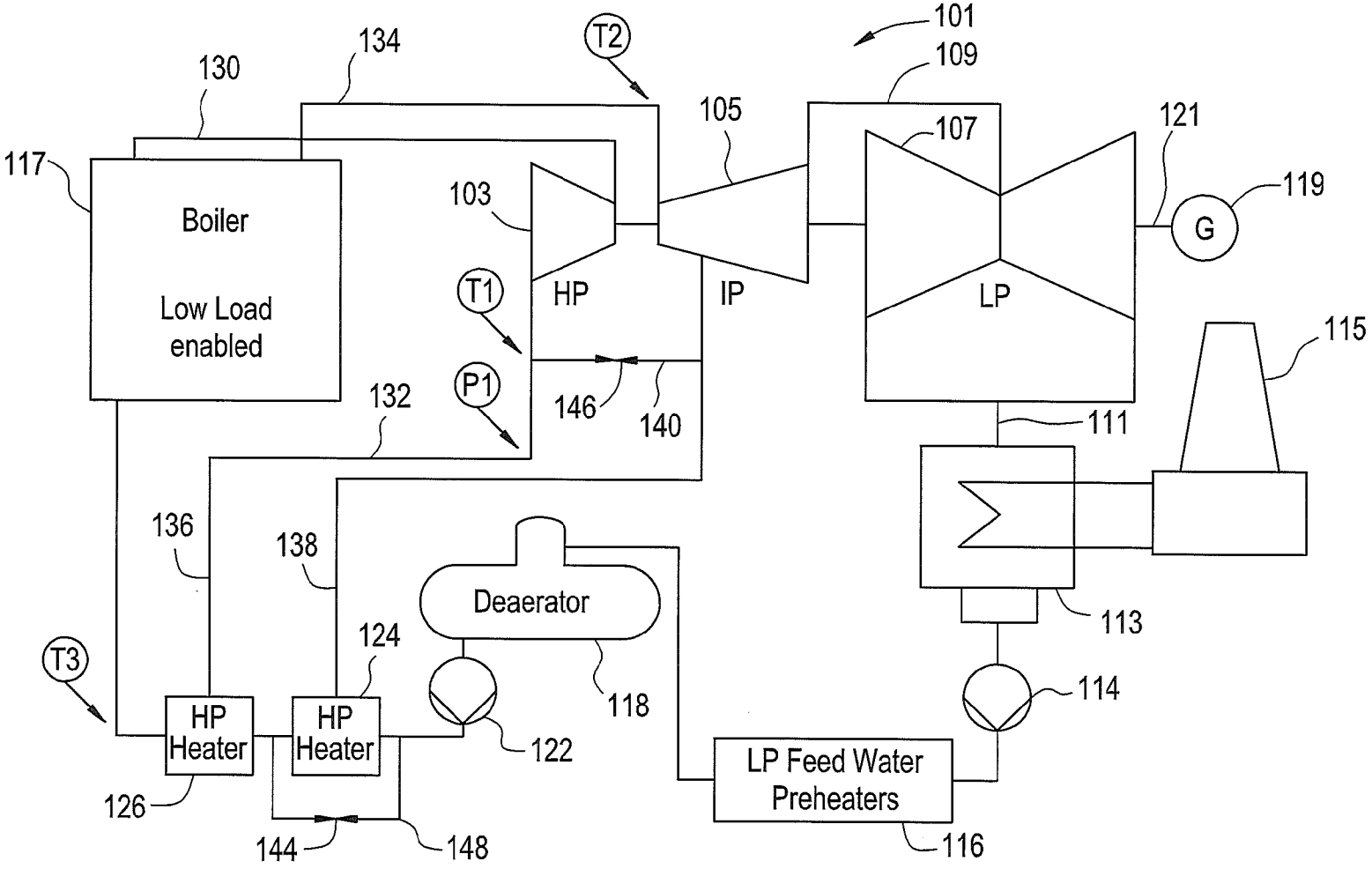
FIG. 2 is a schematic view illustrating one embodiment of a steam plant system frequently operated at low load.

FIG. 2 is a schematic view illustrating one embodiment of a steam plant system 101 frequently operated at low load. In comparison to FIG. 1, differences in FIG. 2 include a partial IP turbine 105 in place of the IP turbine 5 shown in FIG. 1, a relief conduit 140, and bypass conduit 148, along with relief valve 146 and bypass valve 144. These additional and/or modified components will not be explained in further detail.

A partial IP turbine 105 comprises a front stage section with a reduced swallowing capacity as compared to a turbine in a conventional system. As used herein, the swallowing capacity is a measure of capacity of the turbine to accept a portion of steam entering it and then discharge it. The swallowing capacity of the partial IP turbine is reduced by replacing the front stage and moving blades.

Relief conduit 140 is operatively connected to the cold reheat conduit 132 and the IP extraction conduit 138. Relief conduit 140 further comprises a relief valve 146, which selectively controls the flow of steam. Relief valve 146 permits the hot reheat steam to bypass the front stages of the partial IP turbine 105. By bypassing the front stage of the partial IP turbine, relief valve 146 permits the adjustment of the swallowing capacity at higher load levels.

Bypass conduit 148 allows feedwater to bypass the second highest HP heater 124. Bypass conduit 148 further comprises a bypass valve 144, which selectively controls the flow of feedwater. Bypass valve 144 permits the unloading of the second highest HP heater 124 and as a consequence loads the highest HP heater 126. This results in an increase in steam extracted from the cold reheat system 132, which is an alternative way to reduce the reheat pressure in load ranges close or above nominal load.

When a steam power plant is operated at low or part load, the relief valve 146 and bypass valve 144 are fully closed. The pressure and temperature in the cold reheat conduit 132 increases, which results in an improved cycle efficiency. Turbine Cycle efficiency is defined in line with ASME-PTC6 Test Code.

In a conventional steam power plant, such as shown in FIG. 1, at low loads, the temperature of the hot reheat steam drops off. This is the results of flue gas flow in the boiler being too low to maintain the temperature to nominal values. Below a certain load point, the temperature control system of the cold reheat is operated out of range. The embodiment shown in FIG. 2 mitigates this effect by balancing the reheat system through adaptation of the swallowing capacity of the partial IP turbine 105 to increase the pressure in the reheat system at part load and low load. By increasing the back pressure of the HP turbine, the inlet temperature to the partial IP turbine increases. This adaptation leads to a reduced expansion line over the HP-turbine, resulting into a higher HP-exhaust temperature reducing the duty of the reheat system.

When the relief valve 146 is opened, steam is taken away from the cold reheat conduit 132, and travels directly through the IP extraction conduit 138 into the pressure stage of the second highest HP-heater 124 connected to the IP-turbine. The reheat system is therefore unloaded when the relief valve 146 is open. This will lead to an increase in temperature at the outlet of the hot reheat system.

If the sliding pressure values exceed the design pressure value of the system, steam from the cold reheat conduit 132 can be relieved into the relief conduit 140 through relief valve 146, and fed to the second highest HP preheater 124.

When the pressure stabilizes to the design parameters of the system, steam through the relief conduit 140 and to the second highest HP preheater 124 is reduced. In most cases, the heat rate will not deteriorate because the loss pertaining to the throttling is compensated by the increase in temperature at the outlet of the hot reheat conduit 134. For some power plants, when the hot reheat temperature is increased, the heat rate will improve to lower values.

For this reason this concept allows the control of the reheat pressure in the cold reheat conduit 132 with minimum heat rate deterioration, or with even an improved heat rate.

By increasing the reheat steam pressure at all load points below nominal load (P1), the hot reheat steam temperature (T2) in the hot reheat conduit 134 increases, and the final feedwater temperature (T3) rises. Both effects result in improved turbine cycle efficiency as it is defined under the ASME-PTC6 test code.

Operation at High Loads:

When the system is operated at a high load/overload, the pressure increases in the cold reheat conduit system due to the reduced swallowing capacity of the IP-turbine, and causes the temperature to increase as outlined above. When the pressure rises above tolerable values, the newly implemented relief valve 146 selectively opens to control the system pressure. If the temperature with the reduced swallowing capacity is too high, the temperature is then controlled by a spray water system of the hot reheat. An efficiency gain at this load point is possible under the condition that the temperature level in the cold reheat system can be increased beyond the value, that was achieved without the proposed modification. By this modification, a rise in average cycle temperature is achieved, which results in an improved cycle heat rate.

Operation at Low Loads:

When the system is operated at a low load, the pressure is increased in the cold reheat conduit 132 to support the hot reheat temperature (T2) and to increase the extraction pressure at the highest HP heater 136 connected to the reheat system. As a result, the feedwater end temperature (T3) is increased. With a higher hot reheat temperature (T2) and a higher feedwater end temperature (T3), the cycle efficiency improves.

When relief valve 146 and bypass valve 144 are fully closed, the cycle efficiency will benefit from the higher reheat temperature (T2) and the improved feedwater end temperature (T3). In preparation of a fast re-ramp of the plant, the temperature can be temporarily increased at the outlet of the hot reheat conduit 134 by opening relief valve 146. With higher temperatures at the hot reheat conduit and the partial IP-turbine, higher re-ramp gradients will be possible.

A conventional steam plant can be retrofitted to accommodate the steam turbine system described herein by adapting or replacing an IP turbine with a partial IP turbine, and by including a relief conduit and a bypass conduit. Alternatively on existing IP-turbines the swallowing capacity could be adapted by replacing the front stage blade rows. By providing a steam generation apparatus with such components, the apparatus can run at a partial load operation that maintains or increases back pressure of the HP-Turbine, while minimizing temperature variation, and without requiring additional extraction points.

There are multiple technical benefits for a power plant operated at a low load operation in the embodiment described herein. First, the temperature in the hot reheat conduit can be increased. Second, the pressure in the reheat system can be increased, so that the actual pressure deviates less from the optimal reheat pressure of the individual cycle. Third, the feedwater end temperature is increased, which improves also the cycle efficiency. Further, the economizer load is reduced which is very often beneficial for controlling the flue gas temperature. For example, in some power plants with very low final feedwater temperatures at low load, the economizer can absorb too much heat from the flue gas, which results flue gas temperature that is too low to be processed in a SCR system. By reducing the economizer load, optimal flue gas temperature for such systems can be maintained.

As a result, a steam turbine as described herein can be efficiently and economically operated at low load with improved re-ramp capability.

For example, in a power plant such as shown in FIG. 2 that is being operated at low load, when the live steam pressure is 130-170, the optimal reheat pressure is 40 to 47 bar. The optimal value of the reheat pressure rises as a function of the live steam pressure. With the proposed modification, at part load and low load, the reheat pressure could be maintained closer to the optimum of the individual cycle.

In an aspect, a steam turbine generation apparatus includes a boiler for burning fossil fuel to generate steam; a steam turbine including a high-pressure turbine, an intermediate pressure turbine, and a low pressure turbine which are driven by steam generated in the boiler; a main steam conduit for feeding steam from the boiler to an inlet of the high pressure turbine; a cold reheat conduit for feeding steam from an outlet of the high-pressure turbine through a reheat flow path in the boiler, the cold reheat conduit operatively connected to a hot reheat conduit for feeding reheat steam to an inlet of intermediate pressure turbine; a crossover conduit for feeding steam from an outlet of the intermediate turbine to a low pressure turbine; a low pressure exhaust conduit operatively connected to a feedwater conduit, the feedwater conduit providing feedwater in series though a first and second high pressure heaters prior to sending feedwater through the boiler to produce steam into the main steam conduit; a first extraction conduit operatively connecting the cold reheat conduit to the first high pressure heater, wherein the first high pressure heater is operatively associated with the feedwater conduit to transfer heat; a second extraction conduit operatively connecting the intermediate pressure turbine to the second high pressure heater, wherein the second high pressure heater is operatively associated with the feedwater conduit to transfer heat, the second high pressure heater positioned upstream of the first high pressure heater; and a relief conduit selectively transferring steam from the cold reheat conduit to the second extraction conduit.

In still another aspect, the intermediate pressure turbine is a partial intermediate pressure turbine. In yet another aspect, the partial intermediate pressure turbine comprises a front stage section with a reduced swallowing capacity.

In still another aspect, the relief conduit comprises a relief valve.

In yet another aspect the apparatus further comprises a bypass conduit, wherein the bypass conduit is operatively connected to the feedwater conduit so as to selectively allow feedwater to bypass the second high pressure heater and load the first high pressure heater.

In yet another aspect, the apparatus comprises a bypass conduit, wherein the bypass conduit is operatively connected to the feedwater conduit so as to selectively allow feedwater to bypass the second high pressure heater and load the first high pressure heater, wherein the intermediate pressure turbine is a partial intermediate pressure turbine.

In another aspect, a method for effecting temperature and pressure control of a hot reheat conduit in a thermal power plant including a boiler, a high-pressure turbine, an intermediate pressure turbine, and a low pressure turbine which are driven by steam generated in the boiler, the method comprising reducing a swallowing capacity of the intermediate pressure turbine in order to increase the temperature and pressure of the hot reheat conduit, and providing a relief conduit for selectively transferring steam from the cold reheat conduit to the second extraction conduit in order to reduce the temperature and pressure of the hot reheat conduit.

In yet still another aspect, the method further includes providing a bypass conduit to selectively bypass a second high pressure heater and load a first high pressure heater in order to increase the amount of heat extracted from the cold reheat conduit.

While the present invention has been described with reference to a number of embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A steam turbine generation apparatus comprising:

a boiler that burns fossil fuel to generate steam, a steam turbine system including a high-pressure turbine, an intermediate pressure turbine, and a low pressure turbine which are driven by steam generated in the boiler, a main steam conduit that feeds steam from the boiler to an inlet of the high pressure turbine, a cold reheat conduit that feeds steam from an outlet of the high-pressure turbine through a reheat flow path in the boiler, the cold reheat conduit operatively connected to a hot reheat conduit that feeds reheat steam to an inlet of intermediate pressure turbine, a crossover conduit that feeds steam from an outlet of the intermediate turbine to a low pressure turbine, a low pressure exhaust conduit operatively connected to a feedwater conduit, the feedwater conduit providing feedwater in series though a first and second high pressure heaters prior to sending feedwater through the boiler to produce steam into the main steam conduit, a first extraction conduit operatively connecting the cold reheat conduit to the first high pressure heater, wherein the first high pressure heater is operatively associated with the feedwater conduit to transfer heat, a second extraction conduit operatively connecting the intermediate pressure turbine directly to the second high pressure heater, wherein the second high pressure heater is operatively associated with the feedwater conduit to transfer heat, the second high pressure heater positioned upstream of the first high pressure heater, and a relief conduit operatively connecting the cold reheat conduit to the second extraction conduit at a location along the second extraction conduit upstream from an outlet of the second extraction conduit through which steam passes to enter the second high pressure heater, the relief conduit selectively transferring steam from the cold reheat conduit to the second extraction conduit for direct passage to the second high pressure heater to reduce the temperature and pressure of the steam passing through the hot reheat conduit.

2. The apparatus of claim 1 wherein the intermediate pressure turbine is a partial intermediate pressure turbine.

3. The apparatus of claim 1 wherein the relief conduit comprises a relief valve.

4. The apparatus of claim 1 further comprising a bypass conduit, wherein the bypass conduit is operatively connected to the feedwater conduit so as to selectively allow feedwater to bypass the second high pressure heater and load the first high pressure heater.

5. The apparatus of claim 1 further comprising a bypass conduit, wherein the bypass conduit is operatively connected to the feedwater conduit so as to selectively allow feedwater to bypass the second high pressure heater and load the first high pressure heater, wherein the intermediate pressure turbine is a partial intermediate pressure turbine.

6. The apparatus of claim 1, wherein:

the relief conduit extends directly between the cold reheat conduit and the second extraction conduit.

7. The apparatus of claim 1, wherein:

the relief conduit is configured to transfer steam from the cold reheat conduit to the second extraction conduit for downstream passage through the second extraction conduit and to the second high pressure heater.

8. A method for effecting temperature and pressure control of a hot reheat conduit in a thermal power plant including a boiler, a high-pressure turbine, an intermediate pressure turbine, and a low pressure turbine which are driven by steam generated in the boiler, the method comprising:

reducing a swallowing capacity of the intermediate pressure turbine in order to increase the temperature and pressure of a hot reheat conduit, and providing a relief conduit that connects a cold reheat conduit to a second extraction conduit at a location along the second extraction conduit upstream from an outlet of the second extraction conduit, the outlet of the second extraction conduit being directly connected to a high pressure heater for heating feedwater in a feedwater conduit, the relief conduit being configured to selectively transfer steam from the cold reheat conduit to the second extraction conduit for passage directly to the high pressure heater.

9. The method of claim 8 further comprising providing a bypass conduit to selectively bypass a second high pressure heater and load a first high pressure heater in order to increase the amount of heat extracted from steam passing through the cold reheat conduit.

* * * * *